US008689676B2

(12) United States Patent
Van der Blom

(10) Patent No.: US 8,689,676 B2
(45) Date of Patent: Apr. 8, 2014

(54) PISTON-CHAMBER COMBINATION

(75) Inventor: Nicolaas Van der Blom, '-sGravendeel (NL)

(73) Assignee: NVB Composites International a/s, Copenhagen (DK)

( * ) Notice: Subject to any disclaimer, the term of this patent is extended or adjusted under 35 U.S.C. 154(b) by 0 days.

(21) Appl. No.: 13/593,889

(22) Filed: Aug. 24, 2012

(65) Prior Publication Data

US 2013/0047837 A1 Feb. 28, 2013

Related U.S. Application Data

(63) Continuation of application No. 12/308,102, filed as application No. PCT/EP2007/005054 on Jun. 7, 2007, now Pat. No. 8,272,316.

(30) Foreign Application Priority Data

Jun. 7, 2006 (DK) ..... 2006 0773
Jun. 7, 2006 (DK) ..... 2006 0774

(51) Int. Cl.
*F04B 33/00* (2006.01)
*F16F 9/00* (2006.01)

(52) U.S. Cl.
USPC ..... 92/169.1; 92/6 R

(58) Field of Classification Search
USPC ..... 92/6 R, 6 D, 152, 165 R, 166, 168, 169.1; 417/234, 374, 544; 74/543; D23/231
See application file for complete search history.

(56) References Cited

U.S. PATENT DOCUMENTS 1,384,218 A * 7/1921 Stickel ..... 417/63
1,414,621 A * 5/1922 Burnam ..... 417/528
1,431,355 A * 10/1922 Andrews ..... 92/85 R
1,484,549 A * 2/1924 Burnam ..... 417/528
D140,232 S * 2/1945 Russell ..... D23/231
4,583,925 A * 4/1986 Hawkins ..... 417/555.1
5,040,645 A * 8/1991 Volpel et al. ..... 188/287
5,533,435 A * 7/1996 Kita ..... 91/519
6,318,969 B1 * 11/2001 Wang ..... 417/63
7,789,638 B2 * 9/2010 Chuang ..... 417/429
D632,306 S * 2/2011 Wang ..... D15/7
D632,307 S * 2/2011 Wang ..... D15/7
8,272,316 B2 * 9/2012 van der Blom ..... 92/169.1

FOREIGN PATENT DOCUMENTS

WO WO 0070227 A1 * 11/2000

* cited by examiner

*Primary Examiner* — Thomas E Lazo
(74) *Attorney, Agent, or Firm* — Browdy and Neimark, PLLC

(57) ABSTRACT

A piston-combination comprising an elongate chamber bounded by an inner chamber wall, and comprising a piston sealingly movable in the chamber relative to the chamber wall at least between a first and a second longitudinal position of the chamber, said chamber having cross-sections of different cross-sectional areas at the first and second longitudinal positions, and at least substantially continuously differing cross-sectional areas at intermediate longitudinal positions between the first and second longitudinal positions, the cross-sectional area at said second longitudinal position being smaller than the cross-sectional area at the first longitudinal position, said piston changing dimensions and having different cross-sectional areas thereby adapting to different cross-sectional areas of the chamber during the relative movements of the piston between the first and second longitudinal positions through said intermediate longitudinal positions of the chamber, said combination engaging a rigid surface and being movable relative to said surface.

20 Claims, 9 Drawing Sheets b
33
9
25
30
34
36
38
29
28
27
26
37
44
31
a

α
b'
33'
32
25
30
29'
9'
34'
35
28'
26'
a'

9
25
6
b
33
9
25
30
34
38
a

33''
34''
32'
29''
30
25
28''
26''
a''

43

PISTON-CHAMBER COMBINATION

CROSS-REFERENCE TO RELATED APPLICATIONS

This application is a continuation of U.S. application Ser. No. 12/308,102, filed Dec. 8, 2008, now U.S. Pat. No. 8,272,316, issued on Sep. 25, 2012, which is a 371 of International Application Serial No. PCT/EP2007/005054, filed Jun. 7, 2007, which claimed foreign priority from Denmark Pa. 2006 0773, filed on Jun. 7, 2006 and Denmark Pa. 2006 0774, filed on Jun. 7, 2006. The entire contents of all of these applications are herein incorporated by reference.

TECHNICAL FIELD

A piston-chamber combination comprising an elongate chamber which is bounded by a inner chamber wall, and comprising a piston in said chamber to be sealingly movable relative to said chamber wall at least between a first longitudinal position and a second longitudinal positions of the chamber, said combination engaging a rigid surface.

BACKGROUND OF THE INVENTION

This invention deals with solutions for avoiding damaging he combination, as the piston rod and/or the chamber may use a path during the stroke which is not the line or curve of the movement of the force prouder, or force receiver, respectively, the last mentioned provider/receiver engaging the piston rod/chamber.

In specifically Dutch prior art of the beginning of the last century, a number of flexible transitions between the base e.g. a foot plate and the bottom of the cylinder can be observed for classic bicycle floor pumps: a piece of rubber, enabling the cylinder to move in a cone shaped path relative to its base, e.g. a foot plate, having the suspension of the cylinder in/on the foot plate as top of the upside down positioned cone. This enables the torso of the human user (or any other force provider and/or receiver) to move along a curve while pumping by moving the piston rod and/or the chamber, while the piston rod can slide on its own path relative to the chamber and vice versa. This eases the pumping operation for the user.

Floor pumps having a foot plate, e.g. held down to the ground by the foot of the user, and the bottom of the cylinder rigidly fastened to the foot plate, so that the above mentioned movement besides a straight line, is not possible. Many classic pumps have shown the problem that the transition between the cylinder and the foot plate has been damaged by this non-compliance.

Specifically chambers, having differing cross-sectional area's, where the smallest cross-sectional area may just be positioned there where the reaction force of the foot plate to said chamber is highest, may suffer damage. This problem occurs irrespective the chamber type, e.g. having different circumferential length of the cross sections of the chamber or not.

This invention deals additionally with solutions for the problem of optimizing ergonomically aspects, such as optimizing the size of the force during the stroke, and the force transfer by manual operation of a handle of a piston chamber combination, Current straight handles do not comply to the position of the hands of a user in rest, so that the hands need to turn a bit, grip the handle and transfer forces of a substantial magnitude through it, which may be unpleasant.

OBJECT OF THE INVENTION

The object is to provide a device comprising a combination of a piston and a chamber which comply to a path of a force provider or receiver during the stroke. This path may be of any kind.

Additionally to provide a device which has bees optimized economically.

SUMMARY OF THE INVENTION

In the first aspect, the invention relates to a combination of a piston and a chamber, comprising an elongate chamber which is bounded by an inner chamber wall, and comprising a piston in said chamber to be sealingly movable relative to said chamber wall at least between a first longitudinal position and a second longitudinal position of the chamber, said combination engaging a rigid surface, enabling said movement, where said combination is movable relatively to said surface.

Force providers for enabling the relative movement of the parts of the combination may move themselves, and the path of the last mentioned movement does not at any time comply exactly with the path of the relative movement of the piston rod, the piston and the chamber. Thus the system of the force provider and the combination may provide a flexibility somewhere in the system in order to avoid damage. When the force provider may engaging the combination with changing forces, and which may also keeping the non-moving part of the combination towards a rigid surface, in order to enable said relative movement, there may be conflicting demands towards the combination, if said rigid surface also has the function of providing reaction forces for the combination. The last mentioned may happen when a pump is engaged by a human body, while the pump is being held down to the rigid surface e.g. a floor, by a foot of said user. Specifically when a standing person is using a floor pump for pumping a tyre, and specifically if the floor is not in level. The combination ought therefore be movable in relation to the rigid surface, in order to follow the path of the force provider.

In a second aspect is the problem of non-compliance specifically important when a chamber is used with having cross-sections of different cross-sectional areas at the first and second longitudinal positions, and at least substantially continuously different cross-sectional areas and circumferential lengths at intermediate longitudinal positions between the first and second longitudinal positions, the cross-sectional area and circumferential length at said second longitudinal position being smaller than the cross-sectional at said first longitudinal position—this is also valid in the case where the cross-sectional area's at the first and second longitudinal position having a different size, but an equal circumferential size.

In an optimized embodiment for obtaining the highest level of reduction of energy, the chamber of e.g. a floor pump for tire inflation has a smallest possible cross-sectional area at its bottom and a biggest at its top. Thus at the smallest cross-sectional area is the biggest force moment engaging the transition from the chamber to the base of the pump. The combination should therefore be movable in relation to the rigid surface, in order to follow the path of the force provider.

In a third aspect the combination comprises a base for engaging the combination to a rigid surface, enabling the relative movement of the piston and the chamber, the combination is rigidly fastened to a base, said base is movable relatively to said rigid surfaces.

The basis base may have three engaging surfaces on the rigid surface, ensuring a stable positioning of the combination, even the rigid surface would not be flat. The combination may then turn around any line between two of the three engaging surfaces. This however is a poor solution, as the path of a human force provider normally is a 3-dimensional path. And compensation for a positioning of the combination when said surface is not in level, cannot be obtained by this solution. And, in the case of floor pumps for tire inflation is normally the foot of a user pressing the base of the pomp towards the rigid surface, which might prohibit said movement(s).

In a fourth aspect the combination comprises a base for engaging the combination to a rigid surface, enabling the relative movement of the piston and the chamber, the combination is flexibly fastened e.g. by means of an elastically deformable bushing, to said base.

This solution, combined with a base with three engaging surfaces, is an optimized solution which compiles to all demands: the path of the combination may be any path which is used by the force provider (e.g. user), while the base is standing on the surface, held down e.g. by the foot of the user. Not only can a rigid surface, not in level, be compensated, so that the combination, but not the base, still is being perpendicular water, the user of the floor pump is able to initiate any path during the stroke. After use may the combination automatically coming back to it rest position, namely perpendicular the rigid surface. Alternative technical solutions for said bushing are of course possible, e.g. a ball joint at the end of the cylinder, holding within a ball bearing of the base the ball may be combined with a spring, which limits the deflection of the combination, and returns a deflection to default alter use. This solution (not shown) may be more expensive than the bushing.

In a sixth aspect, the combination may be joined together with the base by means of an elastically deformable bushing. The bushing is mounted in a hole of the base, and the chamber is mounted in the hole of the bushing, or vice versa. With appropriate fittings, the combination may be assembled in the base without being able to move in the longitudinal direction. The combination may at least now rotate in the bushing relative to the base, and thus relative to the rigid surface. The deflection of the combination is deforming the flexible wall of the bushing. The wall thickness of the bushing may be much bigger than the Wall thickness of the chamber, enabling substantial deflection angles of the chamber.

Moreover, it might be possible that the fitting is of such a character, that it may also hold the forces of the combination in relation to the base during the stroke, incl. the ends of the stroke, so that a translation in the longitudinal direction of the combination relative to the base is prevented.

In a seventh aspect, an improved bushing may have a protrusion on its top, which is connected to the top of the base. This prevents the bushing to move in a direction towards the base. By adding another protrusion on the inside of the bushing or at the outside of the combination, combined with a groove the combination and bushing, respectively a possible translation of the combination to and from the base may be prevented.

Moreover, the elastically deformable bushing may serve as the soft stop of the combination, when the piston and/or the chamber is reaching its end point of the movement. This function makes in classic floor pumps for tyre inflation the spring on the piston rod, between the handle and the cap superfluous.

In a eighth aspect, the combination comprising an elongate chamber which is hounded by an inner chamber wall, and comprising a piston in said chamber to be sealingly movable relative to said chamber wall at least between a first longitudinal position and a second longitudinal position of the chamber, said combination engaging a rigid surface, enabling said movement, where the combination comprises a piston rod, said piston rod guided by a guiding means connected to the combination, e.g. the cab, said guiding means is movable relatively to the chamber.

This is also valid for piston-chamber combinations with differing cross-sectional area sand equal of differing circumferential sizes.

The guiding means may be comprising a washer with a small hole with an appropriate fitting with the piston rod, while this washer may be movable within a bigger hole within the cap: the piston rod may mainly translate in a transversal direction of the combination. The washer may come back to its default position by means of a sprong-force e.g. an O-ring between the hole in the cab, and the outside of the guiding means.

The size of the last mentioned hole is determine the deflection degree of the piston rod, together with how much the construction of the piston is allowing it. If the piston rod is rigidly fastened to the piston, the construction of the piston determines the deflection degree. If e.g. a ball joint is applied between the piston and the piston rod, the deflection degree is only determined by the guiding means.

In a ninth aspect, in order to allow a deflection of the piston rod in relation to the longitudinal centre axis of the rest of the combination, the contact surface of the guiding means may be circular line, e.g. by a convex cross-sectional inner wall of the hole in the guiding means.

In a tenth aspect, the piston may be rounded off, so as to comply to the movement of the piston rod, or the connection of the piston to the piston rod may be flexible, turnable.

In the eleventh aspect, the invention relates to a combination of a piston and a chamber, wherein:

the centre line of the portions of the handle, positioned opposite the centre axis of the combination have an in between angle different from 180°.

The centre lines of the hands of a user when, operating a handle of a pump have different positions, depending on how the handle is being gripped by the hand(s).

In the case of classic floor pumps, with cylinders with circular cross sections of constant size, high working forces may occur. If relatively high forces are to be transferred from the arm of the user through fee hand, connected to this arm, the hand will be best positioned in relation to the arm, when no force moments would arise. This is obtained if the longitudinal axis of the arm goes through the center point of the axis of a portion of the handle, the handle gripped by the hand, connected to the arm.

Due to the relative big size of the force, the grip of the hand on the handle ought to be firm—this may be done by a hand curve like an open fist: the design of the handle may comprise a portion which has circular cross sections. The sizes of the sections may vary, depending on the distance to the centre axis of fee piston chamber combination.

A preferred angle between the portions of the handle may in a plane perpendicular the centre axis of the piston-chamber combination be 180°. However, it may also be different from 180°. Additionally may the angle be in a plane which comprises said centre axis less than 180°. In order to avoid the hands from gliding from these portions, stops may be provided for—these may also be used for the force transfer. The other options, 180° and more than 180° may of course also occur.

In the case of innovative floor pumps with a chamber with transversal cross sections of varying sizes between two positions of the chamber in a longitudinal direction, the forces may be low. If relatively low forces are to be transferred from an arm of the user through a hand, connected to said arm, the hand may be positioned in relation to the arm, so that a certain force moment may arise. The contact area is that of an open hand. The handle may be designed with a cross section bounded by the curve of e.g. an ellipse. The axis perpendicular the centre axis of the piston-chamber combination may be larger than the axis parallel to said axis.

Preferred angles between the two portions of the handle in a plane perpendicular to the centre axis of the piston-chamber combination may be bit less than bit bigger (best!) than 180°. These positions of the portions of the handle comply to the rest position(s) of the hand(s). Both positions may be obtained by one handle design, if the handle may be able to turn around the centre axis of the piston-chamber combination.

In order to avoid the existence of a force moment, a line through the centres of both portions of the handle in a plane perpendicular the centre axis of the piston-chamber combination cut the last mentioned axis.

In a plane which comprises the centre axis of the piston-chamber combination the angle may be 180° or less, or different than that.

The conical shape of the cylinder may provide a substantial reduction of the size of the working force. By a special arrangement is the shape of the conical cylinder in the longitudinal direction of the chamber formed in such a way, that the force on the handle remains constant during the stroke. This force may be altered when a valve is opening late, e.g. due to the fact that the valve piston is sticking on the valve seed, or that there be dynamic frictions, e.g. due to small sizes of cross sections of channels—thus by forces originated by other sources than the shape of the chamber. Additionally may the friction of the piston to the wall of the chamber alter during the stroke, due to a change in size of the contact area. The shape of the cylinder shown in the longitudinal direction in all relevant drawings of this patent application is made in the above mentioned way while the transversal cross-sections of the conical cylinder are circular—also this is shown in relevant drawings. The limitation to the shape is the smallest size of the piston.

Thus, the invention also relates to a pump for pumping a fluid, the pump comprising:

a combination according to any of the above aspects, means for engaging the piston from a position outside the chamber, a fluid entrance connected to the chamber and comprising a valve means, and a fluid exit connected to the chamber, In one situation, the engaging means may have an outer position where fee piston is in its first longitudinal position, and an inner position where the piston is in its second longitudinal position. A pump of this type is preferred when a pressurised fluid is desired.

In another situation, the engaging means may have an outer position where the piston is in its second longitudinal position, and an inner position where the piston is in its first longitudinal position. A pump of this type is preferred when so substantial pressure is desired but merely transport of the fluid.

In the situation where the pump is adapted for standing on the floor and the piston/engaging means to compress fluid, such as air, by being forced downwards, the largest force may, ergonomically, be provided at the lowest position of the piston/engaging means/handle. Thus, in the first situation, this means that the highest pressure is provided there. In the second situation, this merely means that the largest area and thereby the largest volume is seen at the lowest position. However, due to the fact that a pressure exceeding that in the e.g. tyre is required in order to open the valve of the tyre, the smallest cross-sectional area may be desired shortly before the lowest position of the engaging means in order for the resulting pressure to open the valve and a larger cross-sectional area to force more fluid into the tyre (See FIG. 2B).

Also, the invention relates to a shock absorber comprising:

a combination according to any of the combination aspects, means for engaging the piston from a position outside fee chamber, wherein the engaging means have an outer position where the piston is in its first longitudinal position, and an inner position where the piston is in its second longitudinal position.

The absorber may further comprise a fluid entrance connected to the chamber and comprising a valve means.

Also, the absorber may comprise a fluid exit connected to the chamber and comprising a valve means.

It may be preferred that fee chamber and the piston forms an at least substantially sealed cavity comprising a fluid, the fluid being compressed when the piston moves from the first to the second longitudinal positions.

Normally, the absorber would comprise means for biasing the piston toward the first longitudinal position.

Finally, the invention also relates to an actuator comprising:

a combination according to any of the combination aspects, means for engaging the piston from a position outside the chamber, means for introducing fluid into the chamber in order to displace the piston between the first and the second longitudinal positions.

The actuator may comprise a fluid entrance connected to the chamber and comprising a valve means.

Also, a fluid exit connected to the chamber and comprising a valve means may be provided.

Additionally, the actuator may comprise means for biasing the piston toward the first or second longitudinal position.

BRIEF DESCRIPTION OF THE DRAWINGS

In the following, preferred embodiments of the invention will be described with reference to the drawings wherein the invention is explained in detail below by means of diagrams and drawings. The following is shown in the diagrams or drawings—a transversal cross-section means a cross-section perpendicular to the moving direction of the piston and/or the chamber, while the longitudinal cross-section is the one in the direction of said moving direction.

DESCRIPTION OF PREFERRED EMBODIMENTS

Figure 1A:
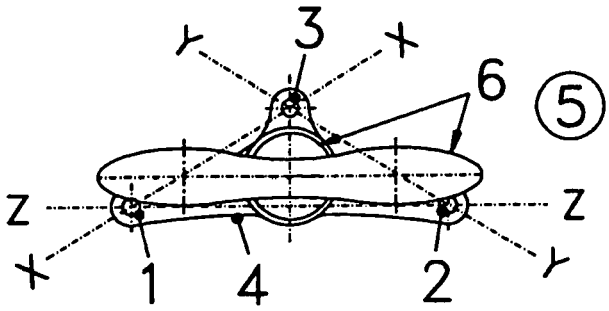
FIG. 1A shows a top view of a pump of a floor pump type of FIG. 1B, where the combination can turn around a line XX, YY or ZZ in relation to the floor surface, while the angle is not restricted by the suspension.

FIG. 1A shows line XX between two of the three engaging surfaces 1,2 of the base 4 with a rigid surface 5, around which the combination 6 may move. The line Y-Y between two of the three engaging surfaces 2,3 of the base 4 with a rigid surface 5, around which the combination 6 may move. The line Z-Z between two of the three contact points 1,2 of the base 4 with a rigid surface 5, around which the combination 6 may move.

Figure 1B:
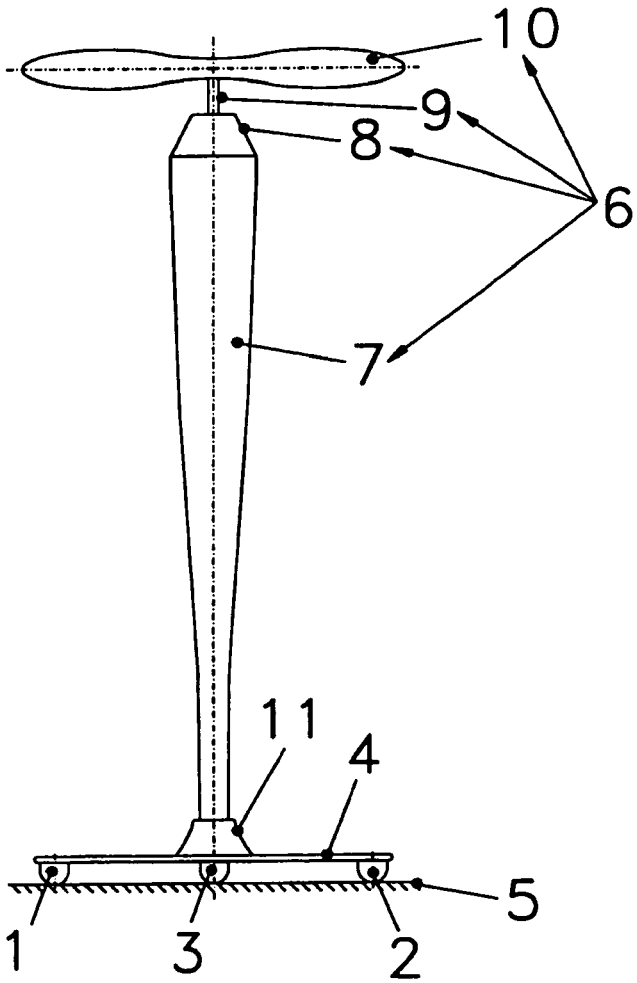
FIG. 1B shows a back view of the floor pump of FIG. 1A.

FIG. 1B shows the combination 6, comprising a chamber 7, a guiding 8 for the piston rod 9 a handle 10. The base 4 with contact points 1, 2 and 3, which are rounded off towards the rigid surface. The chamber 7 is rigidly connected to the base 4 by means of reinforcement 11.

Figure 2A:
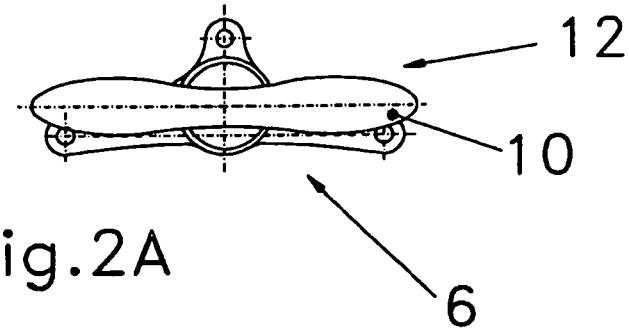
FIG. 2A shows top view of a pump of a floor pump type of FIG. 2B, where the combination can move in 3 dimensions in relation to the surface, while the angle is restricted by spring force of the transition between the combination and the base.

FIG. 2A shows the handle 10 of the combination 6 when the combination 6 is in its rest position 12.

Figure 2B:
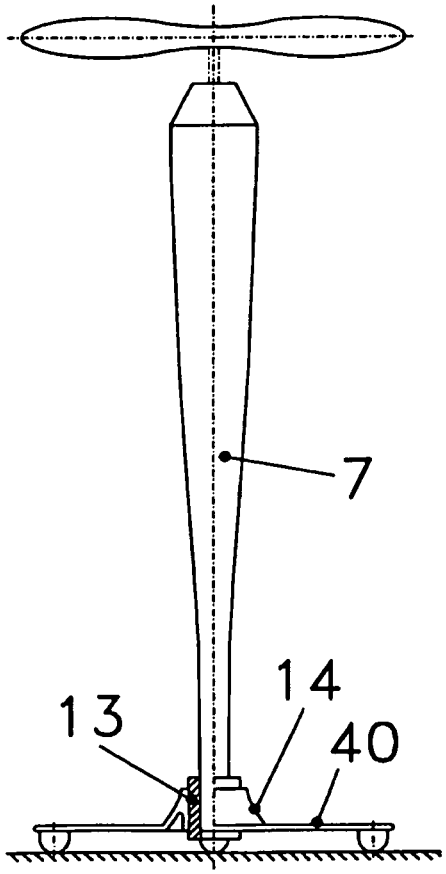
FIG. 2B shows the back view of the floor pump.

FIG. 2B shows the combination 6 in its rest position 12, when the transition 13 between the combination 6 and the reinforcement 14 of the base 40 is in its rest position. The transition 13 may be made of a flexible material, and is positioned around the chamber 7.

Figure 2C:
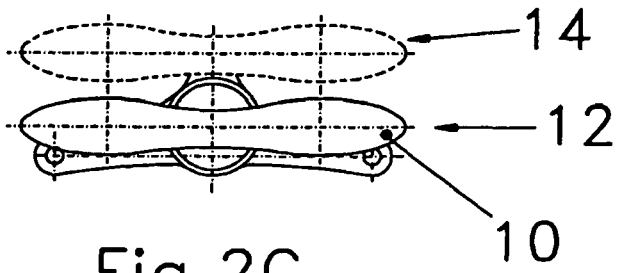
FIG. 2C shows a top view of the pump of FIG. 2B, where the handle has been moved to a position in front of its rest position.

FIG. 2C shows the activated position 14 of the handle 10, when the handle 10 has been moved from its rest position 12 at the front side of the said rest position.

Figure 2D:
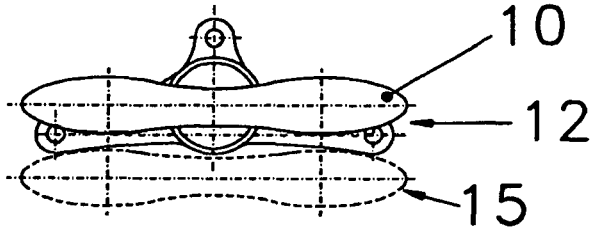
FIG. 2D shows a top view of the pump of FIG. 2B, where the handle has been moved to a position at the back of its rest position.

FIG. 2D show the activated position 15 of the handle 10, when the handle has been moved from its rest position 12 at the back side of the said rest position.

Figure 2E:
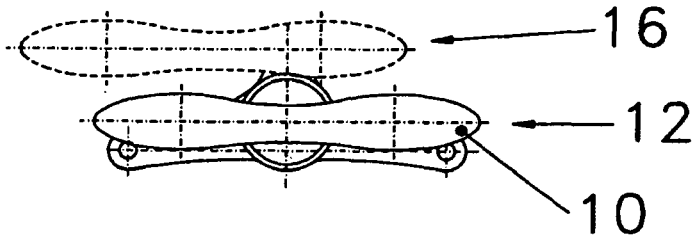
FIG. 2E shows a top view of the pump of FIG. 2B, where the handle has been moved to a left position in front of its rest position.

FIG. 2E shows the activated position 16 of the handle 10, when the handle has been moved from its rest position 12 at the left front side of the said rest position.

Figure 2F:
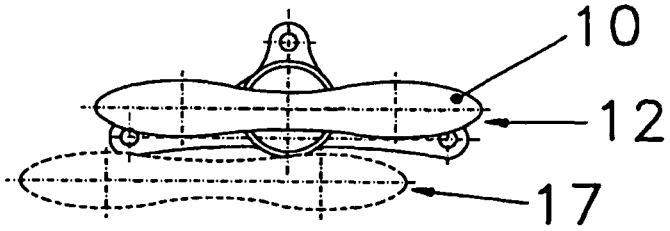
FIG. 2F shows a top view of the pump of FIG. 2B, where the handle has been moved to a left position at the back of its rest position.

FIG. 2F shows the activated position 17 of the handle 10, when the handle has been moved from its rest position 12 at the left back side of the said rest position.

Figure 2G:
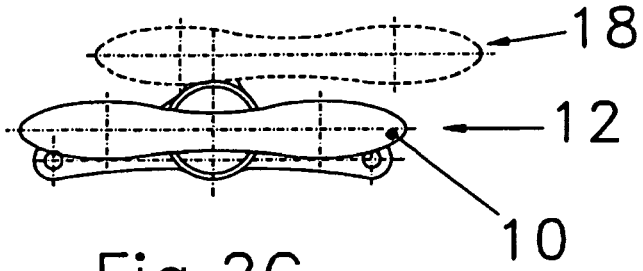
FIG. 2G shows a top view of the pump of FIG. 2B, where the handle has been moved to a right position in front of its position when out of function.

FIG. 2G shows the activated position 18 of the handle 10, when the handle has been moved from its rest position 12 at the right front side of the said rest position.

Figure 2H:
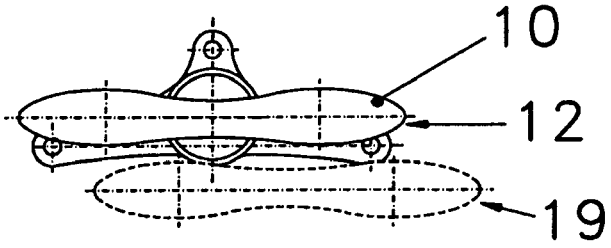
FIG. 2H shows a top view of the pump of FIG. 2B, where the handle has been moved to a right position at the back of its rest position.

FIG. 2H shows the activated position 19 of the handle 10, when the handle has been moved from its rest position 12 at the right back side of the said rest position.

Figure 3A:
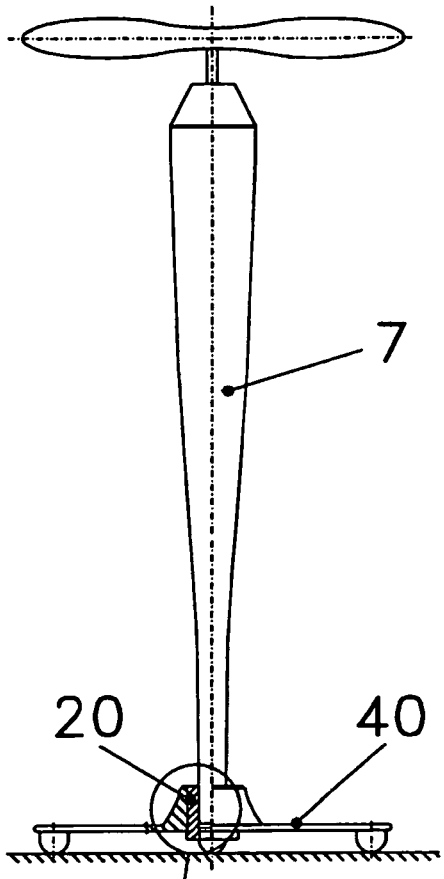
FIG. 3A shows a side view of a floor pump with a flexible transition between the chamber of the combination and the base.

FIG. 3A shows a floor pump where the transition between the chamber 7 and the base 4 is an elastically deformable bushing 20.

Figure 3B:
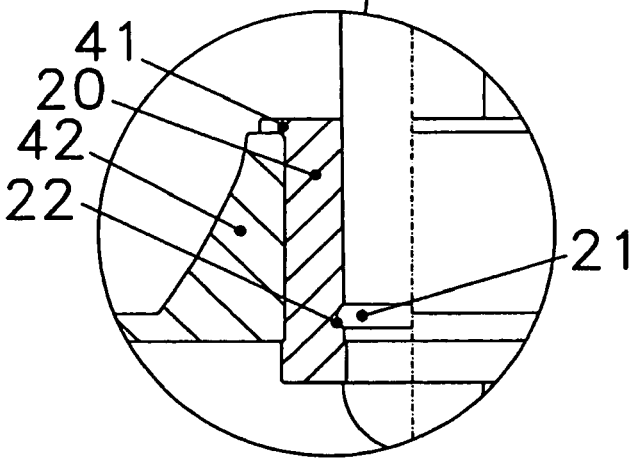
FIG. 3B shows an enlargement of the transition of FIG. 3A.

FIG. 3B shows an enlargement of the transition between the chamber 7 and the base 40. The chamber 7 has a protrusion 21 which complies with a groove 22 in the bushing 20, enabling a simple mounting of the chamber 7 in the base 40. The protrusion 41 on top of the reinforcement 42 of the base 40.

Figure 3C:
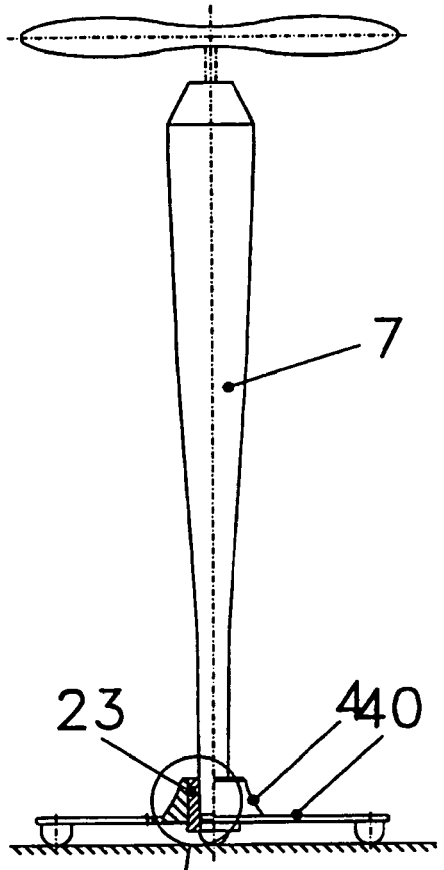
FIG. 3C shows a back view of a floor pump with another flexible transition between the chamber of the combination and the bases.

FIG. 3C shows a floor pump where the transition between the chamber 7 and the base 4 is an elastically deformable bushing 23.

Figure 3D:
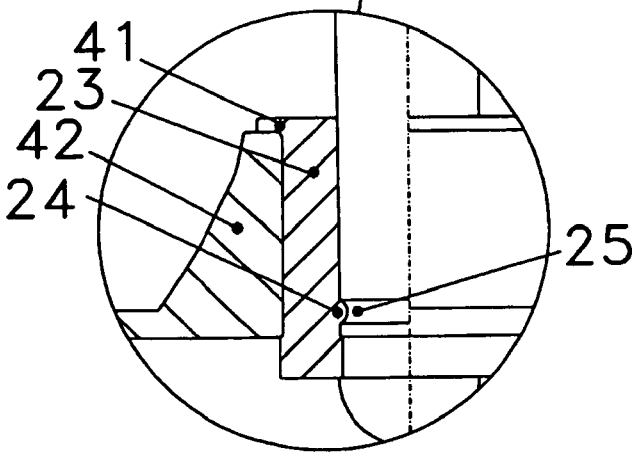
FIG. 3D shows an enlargement of the transition of FIG. 3C.

FIG. 3D shows an enlargement of the transition between the chamber 7 and the 40. The chamber 7 has a groove 25 which complies with a protrusion 24 in the bushing 23, enabling a simple mounting of the chamber 7 in the base 40.

Figures 4A, 4B, 4C, 4D, 4E:
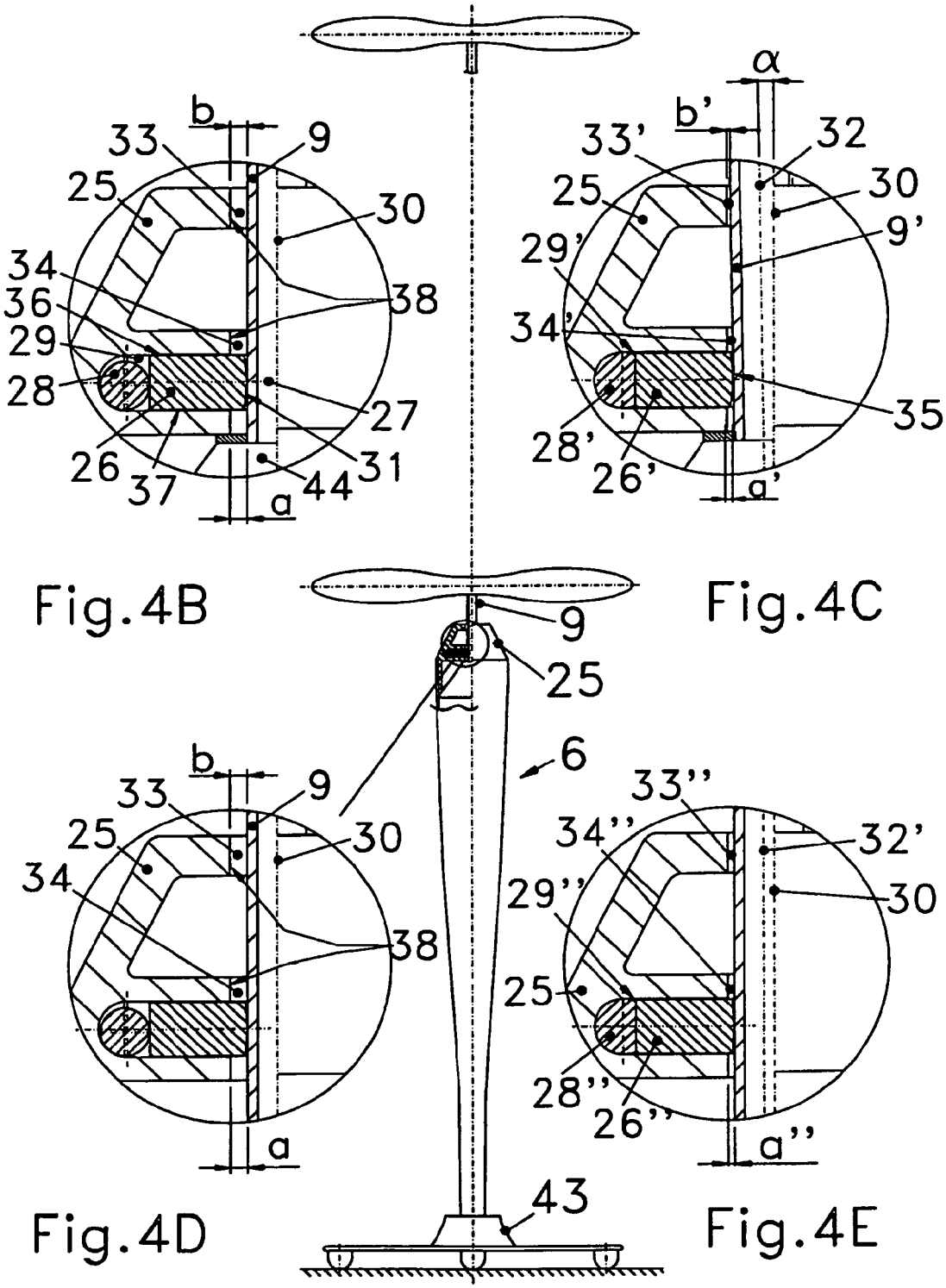
FIG. 4A shows a back view of a floor pomp with a cab which allows the piston rod to move in the transversal direction of the combination.
FIG. 4B shows an enlargement of a transversal cross-section of the cab of FIG. 4A when the piston rod is pulled out to its maximum—no transversal movement.
FIG. 4C shows the transversal cross-section of FIG. 4B when the piston rod is pulled out to its maximum, with a rotation o the piston rod to the left.
FIG. 4D shows an enlargement of a transversal cross-section of the cab of FIG. 4A w when the piston rod is not pulled out—no transversal movement.
FIG. 4E shows the transversal cross-section of FIG. 4D when the piston rod is not pulled out, with a transversal translation of the piston rod to the left.

FIG. 4A shows the combination 6 in the form of a floor pump with a cab 25 which allows a transversal translation and/or deflection of the piston rod in relation to the rest of the combination 6 and the base 43. The base 43 may be directly, by means of the reinforcement 42, or indirectly e.g. by means of a flexible bushing be connected to the base 41.

FIG. 4B shows an enlargement of the cap 25 of FIG. 4A, when the piston 44 is at the end of a stroke farthest from the base 43. The piston rod 9 is moving in a guiding means 26, of which the convex contact inner surface 31 is in line contact at its centre line 27 with the piston rod 9. The guiding means 26 is being held Within the cap 9 by surfaces 36 and 37, and by a flexible O-ring 28. The cross-sectional area of the space 29 between surfaces 36 and 37 of the cap 9 and the guiding means 26 is shown bigger than the cross-sectional area of the ring 28 itself, so as to make a substantial compression of the ring 28 possible (see e.g. FIG. 4C). The distance a between the outside of the piston rod 9 and the Wall 38 of the spaces 33 and 34 of the cab 9. Said distance a may be approximately the same distance b between the piston rod and the Wall 38 of the cab 9 in the top of the cab.

FIG. 4C shows FIG. 4B where the centre axis 32 of the piston rod 9' is deflected angle $\alpha$ in relation to the centre axis 30 of the rest of the combination. The space 29' is almost being filled up by the compressed ring 28', which is compressed by the translated guiding means 26'. The space 34'. The space 33'. The contact surface 35 between the guiding means 26' and the piston rod 9'. Distance a' is smaller than distance a of FIG. 4B. Distance b' is smaller than distance b of FIG. 4B, and more than the difference between distances a and a'.

FIG. 4D shows an enlargement of the cap 25 of FIG. 4A, When the piston 44 may be at the end of a stroke closest to the base 43. The centre line 30 of the combination. The spaces 33 and 34 between the inner walls 38 of the cab 25 and the piston rod 9.

FIG. 4E shows FIG. 4D when the piston rod 9' is translated to the left, to a distance a" between the outside of the piston rod 9' and the inner wall 38 of the cab 25. The guiding means 26" is moved to the left, compressing the ring 28"—shown is that the space 29" has been filled up in this cross-section by the compressed ring 28". The space 33" is approximately equal the space 34" with a distance a" which is equal distance b" which is smaller than distance a.

Figure 5A:
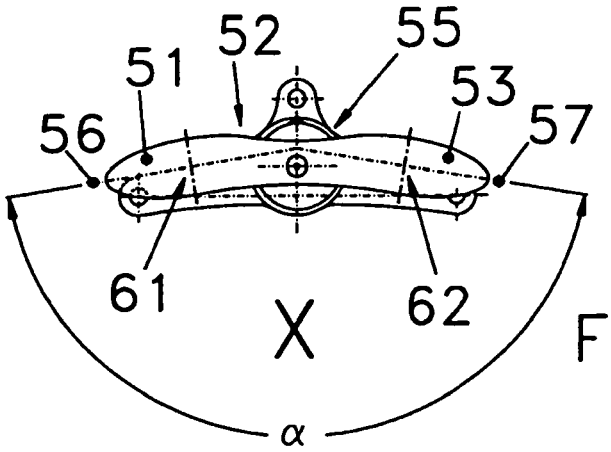
FIG. 5A shows a top view of a floor pump type of FIG. 5B, where the angle between the centerlines of the handle parts opposite the centerline of the combination is less than 180°.

FIG. 5A shows the left portion 51 of the handle 52 and the right portion 53 of the handle 52, in relation to the centre axis 54 of the combination 55. The angle α between the centre axis 56 of the left portion 51 of the handle 52 and the centre axis 57 of the right portion 53 of the handle 52 is less than 180°, when viewing from the position X of the user. The center point 61 of the left portion 51 and center point 62 of right portion 53.

Figure 5B:
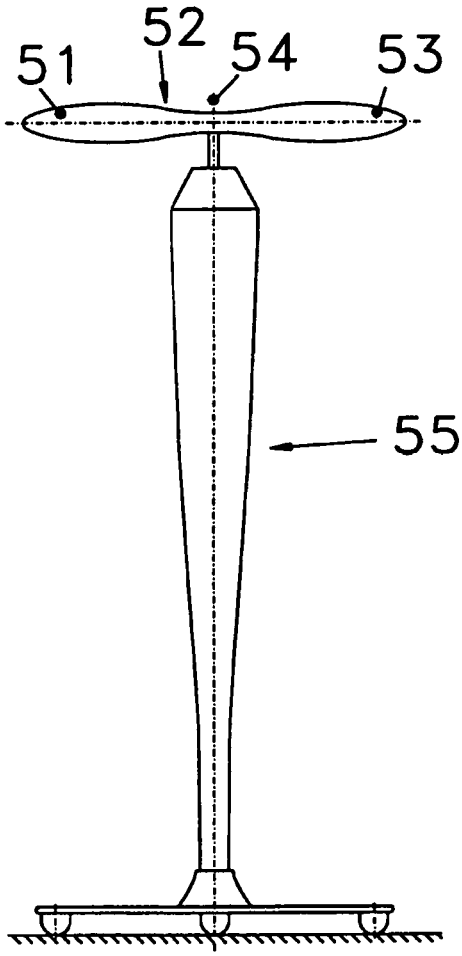
FIG. 5B shows a side view of handle of the floor pump of FIG. 5A.

FIG. 5B shows the a front view of the floor pump of FIG. 5A, comprising the handle 52 and the combination 55, Handle 52 wife the left 51 portion and the right 53 portion. The centre axis 54 of the combination 55.

Figure 6A:
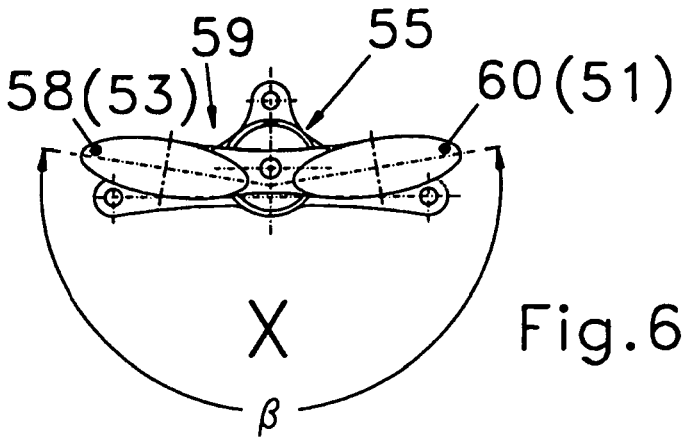
FIG. 6A shows a top view of a floor pump type of FIG. 6B, where the angle between the centerlines of the handle parts opposite the centerline of the chamber is more than 180°.

FIG. 6A shows the left portion 58 of the handle 59 and the right portion 60 of the handle 59, in relation to the centre axis 54 of the combination 55, The angle β between the centre axis 56 of the left portion 58 of the handle 59 and the centre axis 61 of the right portion 60 of the handle 59 is more than 180°, when viewing from the position X of the user.

Figure 6B:
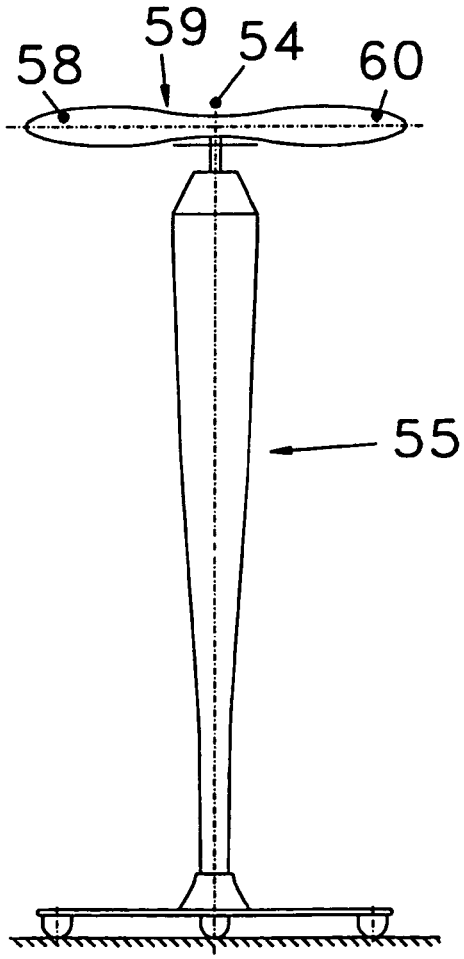
FIG. 6B shows a side view of handle of the floor pomp of FIG. 6A.

FIG. 6B shows the a front view of the floor pump of FIG. 6A, comprising the handle 59 and the combination 55. Use handle 59 with the left 58 portion. (=turned around right portion 53) and the right portion 60 (=turned around left portion 51).

I claim:

1. A piston-chamber combination comprising an elongate chamber which is bounded by an inner chamber wall, and comprising a piston in said chamber to be sealingly movable relative to said chamber wall at least between a first longitudinal position and a second longitudinal position of the chamber, wherein the combination is flexibly fastened to a base for engaging the combination to a rigid surface, the combination being movable relatively to said surface wherein the combination is flexibly fastened to the base by an elastically flexible bushing.

2. The piston-chamber combination according to claim 1, wherein the elastically flexible bushing is mounted in a hole in the basis and the cylinder is mounted in a hole in the bushing.

3. The piston-chamber combination according to claim 1, wherein the bushing is provided with a stop member to prevent the bushing from moving toward the base.

4. The piston-chamber combination according to claim 1, wherein the cylinder is provided with a stop member to prevent the bushing from moving toward the base.

5. The piston-chamber combination according to any one of the claim 1, wherein the bushing comprises a protrusion connected to the top of the basis.

6. The piston-chamber combination according to claim 1, wherein the wall thickness of the bushing is bigger than the wall thickness of the chamber.

7. The piston-chamber combination according to claim 1, wherein the base provided with three engaging surfaces for engaging a rigid surface.

8. The piston-chamber combination according to claim 1, wherein the chamber has cross-sections of different cross-sectional areas and different circumferential lengths at the first and second longitudinal positions, and continuously differing cross-sectional areas and circumferential lengths at intermediate longitudinal positions between the first and second longitudinal positions, the cross-sectional area and circumferential length at said second longitudinal position being smaller than the cross-sectional area and circumferential length at said first longitudinal position, wherein the piston can change dimensions thereby providing for different cross-sectional areas and circumferential lengths of the piston adapting the same to said different cross-sectional areas and different circumferential lengths of the chamber during the relative movements of the piston between the first and second longitudinal positions through said intermediate longitudinal positions of the chamber.

9. The piston-chamber combination according to claim 1, wherein the chamber has cross-sections of different cross-sectional areas and equal circumferential lengths at the first and second longitudinal positions, and continuously differing cross-sectional areas and circumferential lengths at intermediate longitudinal positions between the first and second longitudinal positions, the cross-sectional area and circumferential length at said second longitudinal position being smaller than the cross-sectional area and circumferential length at said first longitudinal position, wherein the position can change dimensions thereby providing for different cross-sectional areas and circumferential lengths of the piston adapting the same to said different cross-sectional areas and equal circumferential lengths of the chamber during the relative movements of the piston between the first and second longitudinal positions through said intermediate longitudinal positions of the chamber.

10. The piston-chamber combination according to claim 1, wherein the piston-chamber combination is a pump, comprising a device engaging the piston from a position outside the chamber, and wherein a fluid exit and a fluid entrance are connected to the chamber by a valve assembly.

11. The piston-chamber combination according to claim 1, wherein the piston-chamber combination is a shock absorber comprising a device engaging the piston from a position outside the chamber, wherein the device has an outer position where the piston is at the first longitudinal position of the chamber, and an inner position where the piston is at the second longitudinal position, wherein the chamber and piston form a sealed cavity comprising a fluid, which is compressed when the piston moves from the first to the second longitudinal position.

12. The piston-chamber combination according to claim 1, wherein the combination is an actuator comprising a device engaging the piston from a position outside the chamber, and a valve assembly by which a fluid is introduced into the chamber in order to displace the piston between the first and second longitudinal position.

13. A piston-chamber combination comprising an elongate chamber which is bounded by an inner chamber wall, and comprising a piston provided within said elongate chamber which is sealingly movable relative to said inner chamber wall at least between a first longitudinal position and a second longitudinal position of the elongate chamber, said piston-chamber combination including a base that engages a rigid surface, wherein said piston-chamber combination is movable relatively to said base and rigid surface, wherein the piston is provided with a handle comprising two portions wherein the two portions each have a center line which are positioned at an angle there between which is different from 180 degrees.

14. The piston-chamber combination according to claim 13 wherein the angle between the two handle portions is different from 180 degrees in a plane perpendicular to the center axis of said piston-chamber combination.

15. The piston-chamber combination according to claim 13, wherein the angle between the two handle portions is different from 180 degrees in a plane comprising the center axis of said piston-chamber combination.

16. The piston-chamber combination according to claim 13, wherein the handle is turnable around the center axis of the piston-chamber combination.

17. The piston-chamber combination according to claim 13, where each portion of the handle has a center point where the force of the hand of the user is concentrated, wherein the line which is drawn from one center of portion to the other is cutting the center axis of the piston-chamber combination.

18. The piston-chamber combination according to claim 13 wherein the piston-chamber combination is a pump, wherein the handle engages the piston from a position outside the chamber, and wherein a fluid exit and a fluid entrance comprising a valve assembly are connected to the chamber.

19. The piston-chamber combination according to claim 13, wherein the elongate chamber has cross-sections of different cross-sectional areas and different circumferential lengths at the first and second longitudinal positions, and continuously differing cross-sectional areas and circumferential lengths at intermediate longitudinal positions between the first and second longitudinal positions, the cross-sectional area and circumferential length at said second longitudinal position being smaller than the cross-sectional area and circumferential length at said first longitudinal position, wherein the piston can change dimensions thereby providing for different cross-sectional areas and circumferential lengths of the piston adapting the same to said different cross-sectional areas and different circumferential lengths of the chamber during the relative movements of the piston between the first and second longitudinal positions through said intermediate longitudinal positions of the chamber.

20. The piston-chamber combination according to claim 13, wherein the elongate chamber has cross-sections of different cross-sectional areas and equal circumferential lengths at the first and second longitudinal positions, and at least substantially continuously differing cross-sectional areas and circumferential lengths at intermediate longitudinal positions between the first and second longitudinal positions, the cross-sectional area and circumferential length at said second longitudinal positions being smaller than the cross-sectional area and circumferential length at said first longitudinal position, wherein the piston can change dimensions thereby providing for different cross-sectional areas and circumferential lengths of the piston adapting the same to said different cross-sectional areas and equal circumferential lengths of the chamber during the relative movements of the piston between the first and second longitudinal positions through said intermediate longitudinal positions of the chamber.

* * * * *